US012571566B2

(12) United States Patent
Conrad et al.

(10) Patent No.: US 12,571,566 B2
(45) Date of Patent: Mar. 10, 2026

(54) CRYOCOOLER MAGNETIC DISPLACER SPRING

(71) Applicant: Teledyne FLIR Commercial Systems, Inc., Goleta, CA (US)

(72) Inventors: Theodore Conrad, Santa Barbara, CA (US); Martin Grabau, Santa Barbara, CA (US)

(73) Assignee: Teledyne FLIR Commercial Systems, Inc., Goleta, CA (US)

( * ) Notice: Subject to any disclaimer, the term of this patent is extended or adjusted under 35 U.S.C. 154(b) by 380 days.

(21) Appl. No.: 18/180,048

(22) Filed: Mar. 7, 2023

(65) Prior Publication Data

US 2023/0288103 A1 Sep. 14, 2023

Related U.S. Application Data

(60) Provisional application No. 63/318,339, filed on Mar. 9, 2022.

(51) Int. Cl.
*F25B 9/14* (2006.01)

(52) U.S. Cl.
CPC ..... *F25B 9/14* (2013.01); *F25B 2309/001* (2013.01); *F25B 2309/003* (2013.01)

(58) Field of Classification Search
CPC ..... F25B 9/14; F25B 2309/001; F25B 2309/003; F25B 9/145
See application file for complete search history.

(56) References Cited

U.S. PATENT DOCUMENTS

| | | | | |
|---|---|---|---|---|
| 4,792,346 | A * | 12/1988 | Sarcia | F02G 1/053 60/520 |
| 5,329,768 | A * | 7/1994 | Moscrip | F25B 9/14 60/520 |
| 5,787,712 | A * | 8/1998 | Fukui | F25B 9/14 60/520 |
| 11,854,858 | B2 | 12/2023 | Veprik | |
| 2003/0121259 | A1* | 7/2003 | Conrad | F02G 1/0445 60/508 |
| 2005/0120721 | A1* | 6/2005 | O'Baid | F25B 9/14 62/6 |
| 2021/0010720 | A1* | 1/2021 | Veprik | F25B 9/14 |
| 2022/0250169 | A1* | 8/2022 | Veprik | H01L 21/6838 |

OTHER PUBLICATIONS

"Cryocooler," webpage <https://en.wikipedia.org/wiki/Cryocooler>, Wikipedia.org, 6 pages, Feb. 13, 2022, retrieved from Internet Archive Wayback Machine <https://web.archive.org/web/20220213034335/https:/en.wikipedia.org/wiki/Cryocooler> on Aug. 16, 2023.

* cited by examiner

*Primary Examiner* — Joel M Attey
*Assistant Examiner* — Ibrahim A. Michael Adeniji
(74) *Attorney, Agent, or Firm* — Haynes and Boone, LLP

(57) ABSTRACT

A cryocooler is disclosed. The cryocooler may include a magnetic spring, a regenerator/displacer, a working fluid, and a cold finger configured to contain the working fluid in a closed system, and to contain the regenerator/displacer that is configured to travel linearly within the cold finger. The magnetic spring may provide a force to cause the regenerator/displacer to return to a center position during thermal cycle operation of the cryocooler. Additional systems and related methods are also provided.

20 Claims, 3 Drawing Sheets

CRYOCOOLER MAGNETIC DISPLACER SPRING

CROSS-REFERENCE TO RELATED APPLICATIONS

This application claims priority to and the benefit of U.S. Provisional Patent Application No. 63/318,339 filed Mar. 9, 2022, and entitled "CRYOCOOLER MAGNETIC DISPLACER SPRING," which is hereby incorporated by reference in its entirety.

TECHNICAL FIELD

This specification relates to a magnetic spring for use in a Stirling cryocooler regenerator/displacer.

BACKGROUND

Stirling cryocoolers utilize the Stirling cycle to convert electricity into the movement of heat from a cold portion towards a heat rejecter. Cryocoolers are very useful and can cool an environment to extremely cold temperatures. A Stirling cryocooler typically has the same mechanical components as a Stirling engine. Cryocoolers can work in reverse as a heat pump, as well. In both the Stirling engine and the heat pump embodiments, heat flows from the expansion space to the compression space.

Cryocoolers typically comprise mechanical springs used for centering the regenerator/displacer. But mechanical springs, particularly coil springs, often generate undesirable side forces or moments. These side forces lead to higher friction, reducing the performance or lifetime of the cryocooler. In the past, these issues have been somewhat mitigated through tight tolerancing and delicate alignment procedures, but these efforts have been difficult to implement, and often only temporary solutions. The springs are difficult to adjust and can easily be caused to be out of alignment.

Thus, there is a need for new devices and systems for providing restorative forces in a Sterling cryocooler.

SUMMARY

In an example embodiment, a cryocooler is disclosed. The cryocooler may comprise: a magnetic spring; a regenerator/displacer; a working fluid; and a cold finger configured to contain the working fluid in a closed system, and to contain the regenerator/displacer that is configured to travel linearly within the cold finger; wherein the magnetic spring provides a force to cause the regenerator/displacer to return to a center position during thermal cycle operation of the cryocooler.

In an example embodiment, a method is disclosed. The method may include containing, by a cold finger of a cryocooler, a working fluid of the cryocooler in a closed system. The method may further include containing, by the cold finger, a regenerator/displacer of the cryocooler, wherein the regenerator/displacer is configured to travel linearly within the cold finger. The method may further include providing, by a magnetic spring of the cryocooler, a force to cause the regenerator/displacer to return to a center position during a thermal cycle operation of the cryocooler.

BRIEF DESCRIPTION OF THE DRAWINGS

Other systems, methods, features, and advantages of the present invention will be apparent to one skilled in the art upon examination of the following figures and detailed description. Component parts shown in the drawings are not necessarily to scale and may be exaggerated to better illustrate the important features of the present invention.

DETAILED DESCRIPTION

Exemplary embodiments of the devices/systems/methods have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

In an example embodiment, a cryocooler device is disclosed. In one example embodiment, and with reference now to FIG. 2, the cryocooler 200 is a split-pair type Stirling cooler. In an example embodiment, a cryocooler is a reverse Stirling engine. Moreover, the cryocooler 200 may be any suitable Stirling engine.

Figure 1:
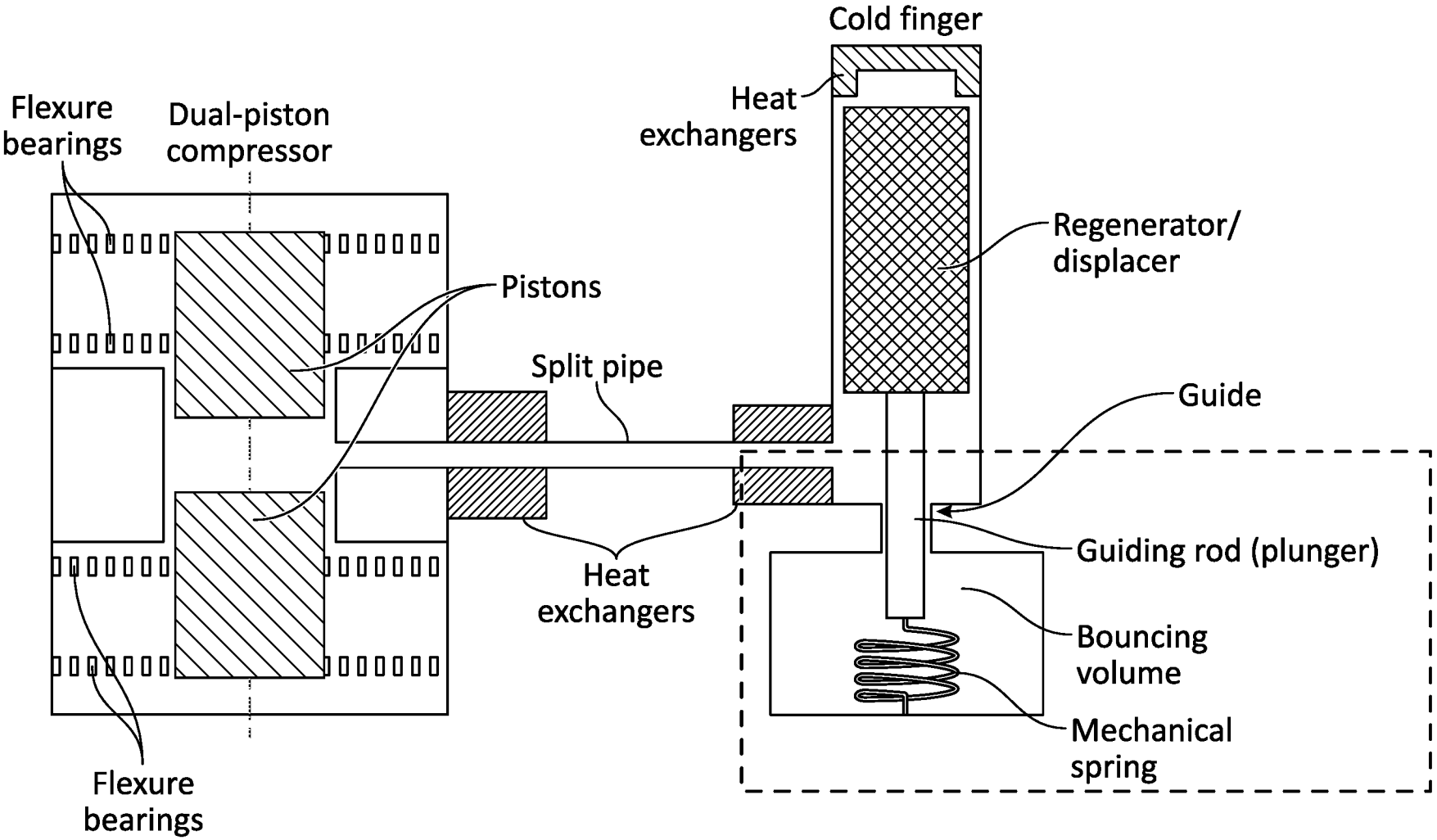
FIG. 1 (Prior Art)
FIG. 1 shows a prior art cryocooler with a mechanical spring.

In an example embodiment, the Stirling cryocooler comprises a magnetic spring, in the place of a traditional mechanical spring (e.g., coil spring or machined spring), associated with the displacer. With brief reference to FIG. 1, a prior art cryocooler with a mechanical spring is illustrated.

The springs (mechanical or magnetic) may also be called 'centering springs.' The magnetic spring, in an example embodiment is configured to return a regenerator/displacer to a normal or center position at a desired spring rate. In an example embodiment, the magnetic spring may be configured to reduce side forces and moments on the displacer compared to a mechanical spring. Side forces lead to higher friction, reducing the performance or lifetime of a cryocooler. Thus, the magnetic spring may be configured to increase the efficiency and/or lifetime of the cryocooler, compared to a cryocooler with a mechanical spring. A mechanical spring requires difficult, precision alignment. But the side forces of the magnetic spring can be controlled through tight but achievable tolerancing of the parts making up the magnetic circuit. In an example embodiment, the magnetic spring may also be configured to reduce the length of the cryocooler cold finger, compared to a cryocooler cold finger with a mechanical spring.

With reference again to FIG. 2, in an example embodiment, the cryocooler 200 comprises a cold finger 210, a working fluid 220, a regenerator/displacer 230, and a magnetic spring 240. In a further example embodiment, the cryocooler 200 further comprises a plunger 250. In a further example embodiment, the cryocooler 200 further comprises a compressor.

Cold Finger 210

In an example embodiment, the cold finger 210 is made of titanium, stainless steel, Inconel (austenitic nickel-chromium-based superalloy), and/or the like. Moreover, the cold finger may be made of any suitable materials that have high strength and low thermal conductivity. In an example embodiment, the cold finger has a cylindrical shape. Moreover, the cold finger may have any suitable outer or inner shape. In another example embodiment, the cold finger 210 is configured for a regenerator/displacer 230 to move within the barrel of the cold finger. Moreover, the cold finger 210 may be configured to provide lateral guidance to the regenerator/displacer 230.

Working Fluid 220

In an example embodiment, the working fluid 220 is contained within the cryocooler, specifically working fluid 220 may be within the cold finger 210. Working fluid 220 may be contained in a closed system. In an example embodiment the working fluid 220 is helium. In other example embodiments, the working fluid 220 is nitrogen, which may be more suitable for high temperature applications. However, the working fluid can be hydrogen, air, methane, ammonia, or any suitable fluid. In an example embodiment, the working fluid is a gas. In an example embodiment, the working fluid may have a low heat capacity J/K.

Regenerator/Displacer 230

Figure 2:
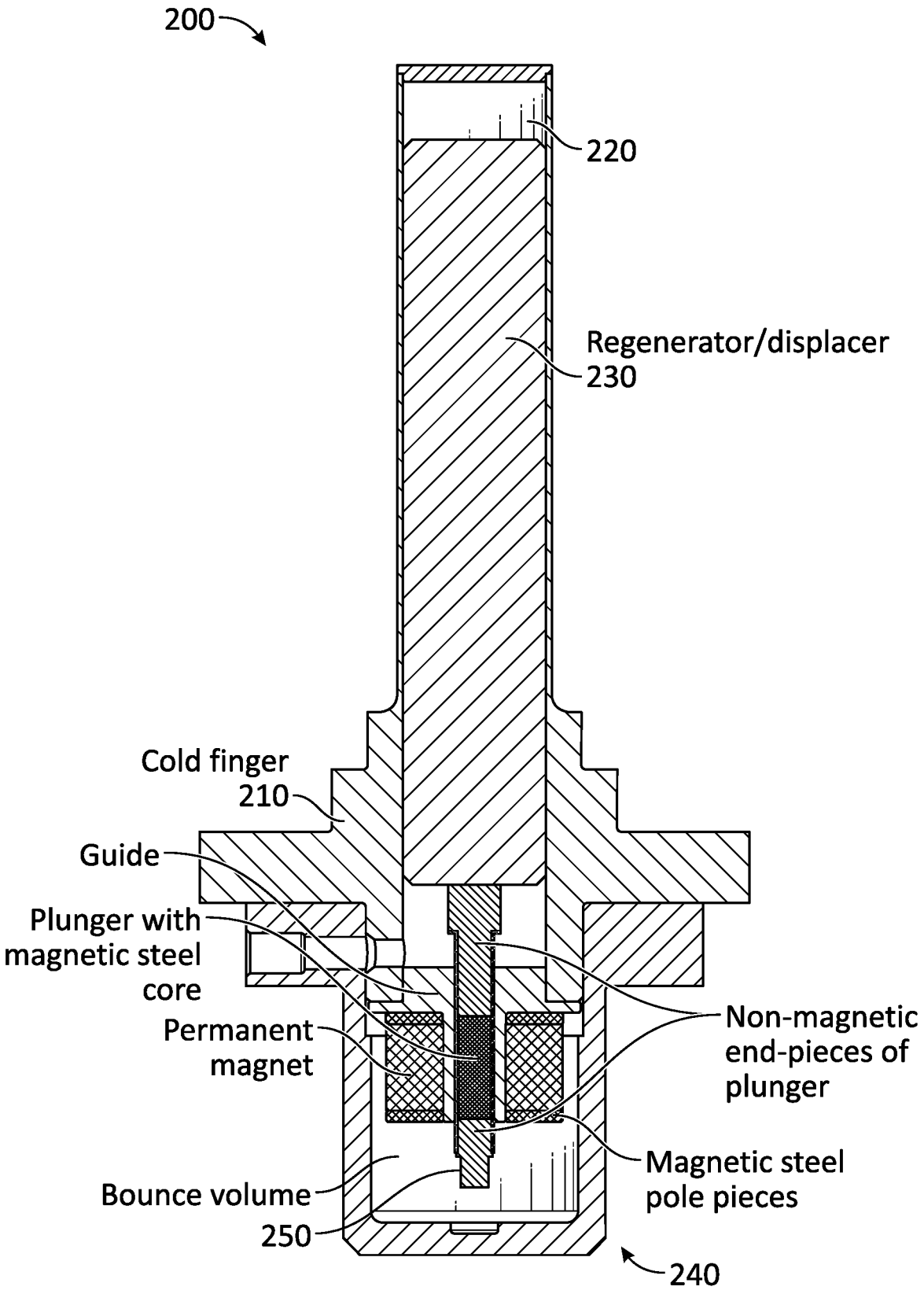
FIG. 2 shows an example cryocooler with a magnetic spring, according to an aspect of the invention.

In an example embodiment, the regenerator/displacer 230 is located within cold finger 210. For example, the regenerator/displacer 230 is configured to slide within cold finger 210. In an example embodiment, the regenerator/displacer 230 is made of stainless steel screens or fibers. In another example embodiment, the regenerator/displacer 230 is made of lead or rare earth spheres. Moreover, any suitable materials may be used for the regenerator/displacer. In one example embodiment, the materials are packed in a structural tube with low thermal conductivity. The regenerator/displacer may be configured to provide a dual function (e.g., a regenerator aspect and a displacer aspect). The regenerator aspect may be configured to act as a heat exchanger, storing and releasing energy at different points in the Stirling cycle. The displacer aspect may be configured to move the working fluid through the regenerator suitable to complete the Stirling cycle. In an example embodiment, a pneumatically driven Stirling cooler is configured with the regenerator and displacer combined into a single element, as illustrated in FIG. 2.

Magnetic Spring 240

In an example embodiment, magnetic spring 240 is configured to provide a restorative force, returning the regenerator/displacer 230 to a neutral or center position. During thermal cycling operation, the regenerator/displacer 230 may be caused to translate within the cold finger 210 such that the mass flow and pressure variation required to execute the Stirling cycle are achieved. In an example embodiment, the motion of the regenerator/displacer is controlled by the combination of pressure, spring, and drag forces acting upon it.

In an example embodiment, the magnetic spring further comprises a magnetic steel core. The magnetic steel core may, for example, be part of the plunger. In an example embodiment, the magnetic steel core may be located in the steel plunger at a location that causes the plunger to come to its neutral, restorative at rest position.

In an example embodiment, the magnetic spring further comprises permanent magnets. For example, the permanent magnets may be located in the cryocooler at a location that draws the magnetic steel core into alignment with the permanent magnets so as to bring the plunger to the neutral position. Thus, the cryocooler is configured with permanent magnets that work in conjunction with a steel core to draw the regenerator/displacer back to a neutral position.

It will be appreciated that although described herein with the permanent magnet affixed relative to the cold finger, and the magnetic steel core affixed relative to the movable regenerator, in other example embodiments, the magnetic steel core can be fixed relative to the cold finger and the permanent magnets can be fixed relative to the movable regenerator.

Moreover, although a couple example embodiments herein illustrate possible locations and orientations of the components of the magnetic spring, any suitable arrangement, locations and orientations of these components that provide a restorative force for centering the regenerator/displacer are within the scope of this disclosure.

In an example embodiment, the permanent magnet may be made from various grades and types of materials (e.g., SmCo, NdFeB, etc.) with varying strength. In one example embodiment, the steel core is a magnetically soft material (having relatively high magnetic permeability). Moreover, the permanent magnet and steel core may be made from any suitable materials and have any suitable size and performance.

In accordance with various example embodiments, the spring rate and travel length of the magnetic spring (i.e., of the plunger and/or the regenerator/displacer) are controlled by the physical dimensions of its permanent magnet and metallic pole pieces, as well as the strength of the magnet which is governed by the qualities of the material. In an example embodiment, the magnetic steel, permanent magnets, and non-magnetic materials interact to produce an axial spring effect, where the axis is in the long direction of the cold finger and the direction of travel of the regenerator/displacer.

Plunger 250

In an example embodiment, the plunger 250 may be configured for aligning the movement of the regenerator/displacer, to slide within a guide, and to provide the structural support for the magnetic spring operation. In an example embodiment, the plunger may comprise a shaft, rod, pole, or other such elongated member. The plunger may be cylindrical, square, or other suitable cross-sectional shape. The plunger may comprise a first end and a second end, and be connected on the first end to the regenerator/displacer.

The cryocooler may further comprise a guide, having an aperture through which the plunger 250 may translate. The guide and plunger 250 may be configured to align the regenerator/displacer within the cold finger, such that it translates within the cold finger 210 with very little friction. The guide may be fixed relative to the cold finger 210.

In an example embodiment, the plunger may comprise three sections: a first non-magnetic end piece section, a magnetic steel core section, and a second non-magnetic end piece section. In this example embodiment, the magnetic steel core section is located between the first and second non-magnetic end piece sections. In an example embodiment, the first non-magnetic end piece section is the portion of the plunger that is attached to the regenerator/displacer 230. Moreover, the plunger may comprise the magnetic steel core in any suitable manner.

Figure 3:
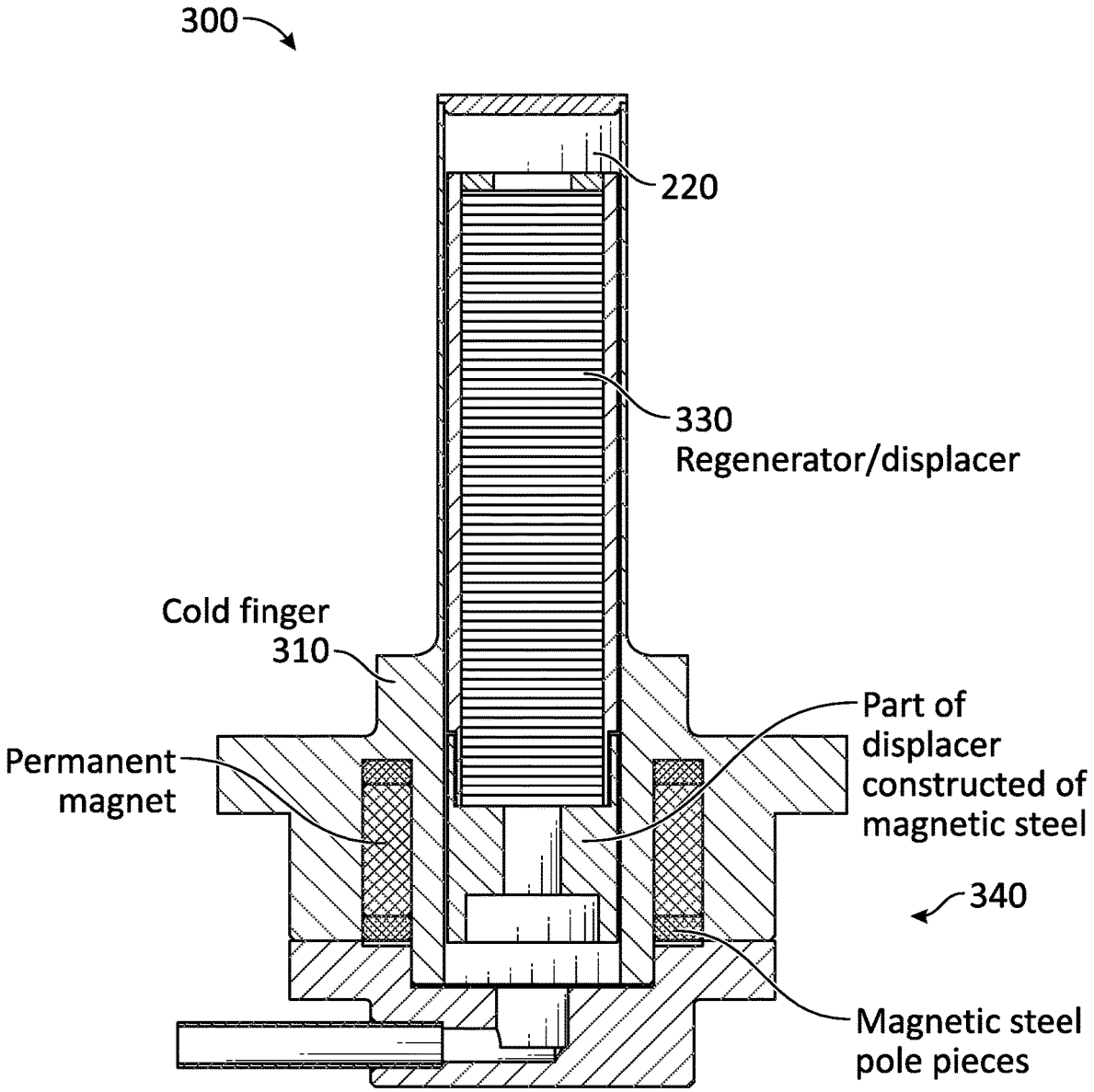
FIG. 3 shows another example cryocooler with a magnetic spring, according to an aspect of the invention.

With reference now to FIG. 3, in an example embodiment, a magnetic spring 340 is used without a plunger. In an example embodiment cryocooler 300 is configured without a plunger. Therefore, the cold finger 310 can be shorter in length, compared to a plunger cryocooler, in the direction of travel of the regenerator/displacer 330. In this example embodiment, the magnetic steel may be part of the regenerator/displacer. In one example embodiment, the magnetic steel is integrated into a seal support.

In an example embodiment, the cryocooler may comprise a compression module, an expander module, a displacer warm end and a displacer cold end. In an example embodiment, the cryocooler further comprises a regenerator. In an example embodiment, the regenerator comprises a matrix of solid porous material, such as granular particles or metal sieves, through which gas flows back and forth. In an example embodiment, heat is stored and released by this material. The regenerator is configured to transfer heat to and from the gas, and to have low flow resistance.

In one example embodiment, the cryocooler is configured to be self-centering. Thus, in an example method of making the cryocooler, the steps of centering the displacer can be skipped. Stated another way, in the method of making the cryocooler, there can be no alignment step.

In the present disclosure, the following terminology will be used: The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" means quantities, dimensions, sizes, formulations, parameters, shapes, and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including, for example, tolerances, measurement error, measurement accuracy limitations and other factors known to those of skill in the art, may occur in amounts that do not preclude the effect the characteristic was intended to provide. Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in the numerical range are individual values such as 2, 3 and 4 and sub-ranges such as 1-3, 2-4 and 3-5, etc. The same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

It should be appreciated that the particular implementations shown and described herein are illustrative of the example embodiments and their best mode and are not intended to otherwise limit the scope of the present disclosure in any way. Furthermore, the connecting lines shown in the various figures contained herein are intended to represent exemplary functional relationships and/or physical couplings between the various elements. It should be noted that many alternative or additional functional relationships or physical connections may be present in a practical device.

As one skilled in the art will appreciate, the mechanism of the present disclosure may be suitably configured in any of several ways. It should be understood that the mechanism described herein with reference to the figures is but one exemplary embodiment of the disclosure and is not intended to limit the scope of the disclosure as described above.

It should be understood, however, that the detailed description and specific examples, while indicating exemplary embodiments of the present disclosure, are given for purposes of illustration only and not of limitation. Many changes and modifications within the scope of the instant disclosure may be made without departing from the spirit thereof, and the disclosure includes all such modifications. The corresponding structures, materials, acts, and equivalents of all elements in the claims below are intended to include any structure, material, or acts for performing the functions in combination with other claimed elements as specifically claimed. The scope of the disclosure should be determined by the appended claims and their legal equivalents, rather than by the examples given above. For example, the operations recited in any method claims may be executed in any order and are not limited to the order presented in the claims. Moreover, no element is essential to the practice of the disclosure unless specifically described herein as "critical" or "essential."

What is claimed is:

1. A cryocooler comprising:

a magnetic spring;

a regenerator/displacer;

a working fluid; and a cold finger configured to contain the working fluid in a closed system, and to contain the regenerator/displacer that is configured to travel linearly within the cold finger;

wherein the magnetic spring provides a force to cause the regenerator/displacer to return to a center position during a thermal cycle operation of the cryocooler;

wherein the magnetic spring comprises a first magnetic part fixed relative to the regenerator/displacer and a second magnetic part fixed relative to the cold finger;

wherein the first magnetic part is part of a plunger coupled to the regenerator/displacer, the plunger comprising a first non-magnetic section attached to the regenerator/displacer and positioned between the regenerator/displacer and the first magnetic part, the plunger also comprising a second non-magnetic section, the first magnetic part being between the first and second non-magnetic sections.

2. A cryocooler comprising:

a magnetic spring;

a regenerator/displacer;

a working fluid; and a cold finger configured to contain the working fluid in a closed system, and to contain the regenerator/displacer that is configured to travel linearly within the cold finger;

wherein the magnetic spring provides a force to cause the regenerator/displacer to return to a center position during a thermal cycle operation of the cryocooler;

wherein the magnetic spring comprises a permanent magnet and a magnetic steel core.

3. The cryocooler of claim 2, wherein:

the permanent magnet is fixed relative to the cold finger; and the magnetic steel core is fixed relative to the regenerator/displacer.

4. The cryocooler of claim 2, wherein the regenerator/displacer is configured to move within a barrel of the cold finger.

5. The cryocooler of claim 2, wherein the magnetic steel core is located relative to the permanent magnet to cause the regenerator/displacer to travel to the center position when not acted upon by thermal cycle forces.

6. The cryocooler of claim 2, wherein one of the magnetic spring and the permanent magnet is formed as part of the regenerator/displacer, and the other is fixed relative to the cold finger.

7. The cryocooler of claim 1, wherein the first magnetic part comprises a magnetic steel core, and wherein a permanent magnet is fixed relative to the cold finger.

8. The cryocooler of claim 1, wherein the first magnetic part comprises a permanent magnet, and wherein the second magnetic part is a magnetic steel core fixed relative to the cold finger.

9. The cryocooler of claim 1, wherein the first magnetic part is a magnetic steel core.

10. The cryocooler of claim 9, further comprising a guide fixed relative to the cold finger for aligning the regenerator/displacer within the cold finger.

11. The cryocooler of claim 1, wherein the plunger is configured for aligning a movement of the regenerator/displacer, to slide within a guide, and to provide a structural support for the magnetic spring operation;

wherein the plunger comprises a shaft, a rod, or a pole.

12. A method comprising:

containing, by a cold finger of a cryocooler, a working fluid of the cryocooler in a closed system;

containing, by the cold finger, a regenerator/displacer of the cryocooler, wherein the regenerator/displacer is configured to travel linearly within the cold finger; and providing, by a magnetic spring of the cryocooler, a force to cause the regenerator/displacer to return to a center position during a thermal cycle operation of the cryocooler;

wherein the magnetic spring comprises a permanent magnet and a magnetic steel core.

13. The method of claim 12, wherein:

the permanent magnet is fixed relative to the cold finger; and the magnetic steel core is fixed relative to the regenerator/displacer.

14. The method of claim 12, further comprising moving the regenerator/displacer within a barrel of the cold finger.

15. The method of claim 12, wherein the magnetic steel core is located relative to the permanent magnet to cause the regenerator/displacer to travel to the center position when not acted upon by thermal cycle forces.

16. The method of claim 12, wherein one of the magnetic spring and the permanent magnet is formed as part of the regenerator/displacer, and the other is fixed relative to the cold finger.

17. The method of claim 12, wherein:

the cryocooler comprises a plunger coupled to the regenerator/displacer;

a portion of the plunger comprises the magnetic steel core; and the permanent magnet is fixed relative to the cold finger.

18. The method of claim 12, wherein:

the cryocooler comprises a plunger coupled to the regenerator/displacer;

a portion of the plunger comprises the permanent magnet; and the magnetic steel core is fixed relative to the cold finger.

19. The method of claim 12, wherein:

the cryocooler comprises a plunger comprising a first non-magnetic portion, the magnetic steel core, and a second non-magnetic portion; and the magnetic steel core is located between the first non-magnetic portion and the second non-magnetic portion.

20. The method of claim 19, further comprising aligning, by the plunger sliding within a guide fixed relative to the cold finger, the regenerator/displacer within the cold finger.

* * * * *